US008608625B2

(12) United States Patent
Quarz

(10) Patent No.: US 8,608,625 B2
(45) Date of Patent: Dec. 17, 2013

(54) VIBRATIONAL ERGOMETER

(76) Inventor: Dieter Quarz, Dusseldorf (DE)

( * ) Notice: Subject to any disclaimer, the term of this patent is extended or adjusted under 35 U.S.C. 154(b) by 617 days.

(21) Appl. No.: 11/813,033

(22) PCT Filed: Dec. 24, 2005

(86) PCT No.: PCT/EP2005/057170

§ 371 (c)(1),
(2), (4) Date: Mar. 7, 2008

(87) PCT Pub. No.: WO2006/069988

PCT Pub. Date: Jul. 6, 2006

(65) Prior Publication Data

US 2009/0048075 A1 Feb. 19, 2009

(30) Foreign Application Priority Data

Dec. 30, 2004 (DE) ..... 10 2004 063 495

(51) Int. Cl.
*A63B 22/06* (2006.01)
*A63B 22/00* (2006.01)

(52) U.S. Cl.
USPC ..... 482/57; 482/4; 482/63

(58) Field of Classification Search
USPC ..... 482/57–65, 51, 1–9
See application file for complete search history.

(56) References Cited

U.S. PATENT DOCUMENTS

| | | | | | |
|---|---|---|---|---|---|
| 1,998,522 | A * | 4/1935 | Pyles | 601/30 |
| 3,713,438 | A | 1/1973 | Knutsen | |
| 4,204,673 | A * | 5/1980 | Speer, Sr. | 482/5 |
| 4,570,927 | A | 2/1986 | Petrofsky et al. | |
| 5,716,331 | A * | 2/1998 | Chang | 601/50 |
| 5,827,205 | A * | 10/1998 | Iwamoto | 601/78 |
| 5,833,583 | A * | 11/1998 | Chuang | 482/60 |
| 6,001,046 | A * | 12/1999 | Chang | 482/57 |
| 6,027,432 | A * | 2/2000 | Cheng | 482/57 |
| 6,077,201 | A * | 6/2000 | Cheng | 482/57 |
| 6,149,611 | A * | 11/2000 | Chen | 601/22 |
| 6,217,491 | B1 * | 4/2001 | Schiessl | 482/92 |
| 6,485,397 | B1 * | 11/2002 | Manderbacka | 482/63 |
| 7,137,929 | B2 * | 11/2006 | Fan | 482/57 |
| 2003/0171190 | A1 | 9/2003 | Rice | |
| 2006/0270527 | A1 * | 11/2006 | Hanaya et al. | 482/57 |

FOREIGN PATENT DOCUMENTS

| | | |
|---|---|---|
| CN | 1235056 | 11/1999 |
| DE | 75 23 938 U | 1/1976 |
| DE | 29 52 634 A1 | 2/1981 |
| DE | 81 07 360 U1 | 10/1981 |
| DE | 19639477 | 4/1998 |
| DE | 102 25 323 A1 | 1/2004 |

(Continued)

OTHER PUBLICATIONS

Translation of the International Preliminary Report on Patentability for International Application No. PCT/EP2005/057170, 11 pages.

*Primary Examiner* — Stephen Crow
(74) *Attorney, Agent, or Firm* — Occhiuti & Rohlicek LLP

(57) ABSTRACT

Vibrational ergometer comprising a seat unit (20), a bottom bracket/crank unit (1) connected to a braking unit (4) as well as a vibrational unit, the latter consisting of a plate vibrator (2), a vibrational stand (18) and vibrational motors (3), wherein the plate vibrator (2) is connected to the bottom bracket/crank unit (1) and the bottom bracket/crank unit (1) is mechanically decoupled from the seat unit.

22 Claims, 4 Drawing Sheets

(56) References Cited

FOREIGN PATENT DOCUMENTS

| | | |
|---|---|---|
| DE | 102 41 340 B4 | 3/2004 |
| DE | 103 13 524 B3 | 9/2004 |
| JP | 59-211470 | 11/1984 |
| JP | 10-216287 | 8/1998 |
| NL | 1021619 | 4/2004 |

* cited by examiner

VIBRATIONAL ERGOMETER

CROSS-REFERENCE TO RELATED APPLICATIONS

This application is being filed as a U.S. National Stage under 35 U.S.C. 371 of International Application No. PCT/EP2005/057170, filed on Dec. 24, 2005, which claims the benefit of German Application No. 10 2004 063 495.5, filed Dec. 30, 2004. The contents of both applications are hereby incorporated by reference in their entirety.

The invention relates to a vibrational ergometer and application thereof.

In order to exercise a positive and efficient influence on the individual performance structure of rehabilitation and geriatric patients or competitive athletes, as great a number of dosed external training stimuli as possible must be transformed to the various structural levels of the human organism in a well-balanced and adjusted manner. Therein, components with regard to condition (power, perseverance, quickness, flexibility) and coordination (neuromotorics) should be taken into consideration in the spectrum of application of the training means.

In terms of new training alternatives, a multitude of vibration training devices have led to an optimized physiological performance through reactivation of pathologically degenerate functional systems of human structures or through an increase in the capacity of intact functional systems of said human structures. Although medical vibration training (MVT) is already in commercial use, scientific safeguarding of the method has not gone beyond basic research yet. Publications which are based on the science of sport can be found in the articles by Künnemeyer/Schmidtbleicher et al. ("Die rhythmisch neuromuskuläre Stimulation" in: Leistungssport, February 1997, pp. 39-42) and Weber et al. ("Muskelstimulation durch Vibration" in: Leistungssport, January 1997, pp. 53-56).

Apparatuses transferring vibration energy to the user have been disclosed in a multitude of publications:

For example, U.S. Pat. No. 4,570,927 shows an apparatus wherein the legs of a paraplegic patient are moved by a crank unit driven by a motor.

NL 102 16 19 C describes a device wherein vibration energy is transferred to the upper extremities through a handle bar.

DE 102 41 340 A1 discloses an apparatus wherein a vibratode transmits vibrations selectively to stretched muscular structures.

A further vibrational apparatus is claimed in DE 102 25 323 B4, wherein stochastic resonances are transmitted to the user through a mechanically complicated construction.

DE 196 39 477 A1 shows an apparatus with a seat, a handle bar and a vibrational unit wherein vibrations are applied to the user's feet.

Application of the five afore-mentioned apparatuses in combination with or as an ergometer, for example through a braking unit connected to the crankshaft, is not disclosed.

Implementation of vibrations according to bicycle ergometry conditions is described by Samuelson et al. ("Influence of Vibration on Work Performance During Ergometer Cycling" in: Uppsala Journal of Medicine Sciences (1989)94, pp. 73-79) and by Treler et al. ("Weichteile" in Radmagazin "tour", February 1999, pp. 26-33). In either case, simulation is achieved through structural improvisations, i.e. through mounting of a complete structural frame to a hydropulser and, respectively, through fixing a complete ergometer onto a plate vibrator.

DE 103 13 524 B3 discloses a training device wherein individual contact points which can be subjected to vibrations or a plurality of such contact points are mechanically isolated from the trainee in terms of vibration through one or more damping elements, with the result that all assemblies provided to support the user's body parts are caused to vibrate.

All of the ergometer systems mentioned above are based on the principle of positioning the user and the applied training means on a plate vibrator. All components used for supporting the trainee apply vibration energy to the body parts coming into contact with said components and to the corresponding body segments.

This results in whole body vibrations ("WBV") some of which exceed the limit values stipulated in DIN ISO 2631 as being permissible by occupational medicine. Resonance conflicts reduce the application time, thus resulting in (time-limiting) efficiency minimization. Due to the structural isolation of the features of MVT apparatuses to the uniform neuromotoric stimulation of intramuscular coordination while focusing on the power component with regard to condition, there is no wide-range GKV multifunctionality with regard to both condition and coordination. The prior-art MVT products cover only a selective segment of training therapy, and these apparatuses do not allow implementation of a holistic training concept. Instead, they must be combined with conservative training devices (e.g. with cardio devices in warm-up/cool-down mode and supplementing mechanical resistance training).

The present invention aims at providing a vibrational ergometer which can be used in training therapy in an integrative manner, in particular for rehabilitation and geriatric patients or competitive athletes, which covers as wide a requirement profile for training means as possible without having to be combined with conservative training devices, and which comprises low space requirements so that it is, for example, used in aeronautics.

This problem is solved by means of a vibrational ergometer comprising a seat unit (20), a bottom bracket/crank unit (1) connected to a braking unit (4), as well as a vibrational unit, with the latter consisting of a plate vibrator (2), a vibrational stand (18) and vibrational motors (3), wherein the plate vibrator (2) is connected to the bottom bracket/crank unit (1) and the bottom bracket/crank unit (1) is mechanically decoupled from the seat unit.

In particular, use is not made of damping elements to decouple the plate vibrator (2) from the bottom bracket/crank unit (1) in a mechanical or vibration-engineering manner.

Since, according to the invention, the seat unit (20) is mechanical decoupled from the vibrational unit, an essential element according to the invention ensures that not all of the assemblies provided to support the trainee are operably connected to the appropriately associated body part of the trainee (to the vibration).

According to the invention, the vibrations almost exclusively act on the lower extremities if the bottom bracket/crank unit (1) is rotated by the lower extremities, while the buttocks, the upper extremities, the body stem and the head are subjected to such vibrations to a minor degree only.

These differences can be measured by means of acceleration transducers. Examinations have shown that through simple mechanical decoupling (e.g. by means of damping elements of the vibrational unit), in this case (rotation of the bottom bracket/crank unit by the legs), the energy measured at the ankle joint of the foot is still more than 80 percent of the energy measured at the plate vibrator; less than 50 percent of the energy produced by the plate vibrator was measured at the knee while, at the head, less than 5 percent of the energy produced by the plate vibrator was measured.

According to the invention, the vibrations almost exclusively act on the upper extremities if the bottom bracket/crank unit (1) is rotated by the upper extremities, while the buttocks, the lower extremities, the body stem and the head are subjected to such vibrations to a minor degree only.

The measurable differences in the vibration energy transferred to the trainee (e.g. wrist and buttocks) are considerable in this embodiment as well.

According to the present invention, it is, for the first time, possible to provide a training device wherein a wide training means requirement profile is covered through vibration energy, which is transferred selectively to selected body parts (or body regions) under ergometry conditions, without combination with additional conservative training devices.

The invention is, in particular, to advantage in that complex training means application with lowest space requirements can be implemented through simultaneously providing an especially acting vibrational unit which generates resistance mechanically and comprises a modified ergometer construction. This results in a multifunctional training device within the scope of MVT which transforms stimuli for physiological adaptations intended to improve the users' individual performance structures with regard to both coordination and condition. What is more, the weight of the apparatus can be reduced considerably by using GFK or carbon reinforced composite materials without affecting functionality.

The term "seat unit" is, in particular, to be interpreted as a saddle, such as known from bicycle construction.

For the first time, the apparatus according to the present invention allows to provide a vibrational ergometer of a compact design.

In a preferred embodiment, the bottom bracket/crank unit (1) is mounted to the vibrational unit as a separate assembly. In this manner, it is ensured that the vibrations acting on the bottom bracket/crank unit (1) are effectively decoupled from the seat unit (20).

This embodiment is additionally to advantage with regard to undesired transmission of vibrations to further parts of the trainee's body which come into contact with further components of the vibrational ergometer according to the invention and should not be subjected to said vibrations.

In a further preferred embodiment, the vibrational ergometer, in addition, comprises a frame superstructure (17) wherein the seat unit (20) is connected to said frame superstructure (17). This embodiment is used as a bicycle ergometer.

Here and below, the term "frame superstructure" is to be interpreted as that part of a bicycle which consists of chainstays, rear fork stays (and associated fork ends), seat tube, down tube, head tube, fork (with associated fork ends), and top tube. As a result, the bottom bracket sleeve with crank unit (i.e. the bottom bracket/crank unit (1)) is not covered by the term "frame superstructure".

According to the present invention, the vibrational unit, i.e. the plate vibrator (2), the vibrational stand (18) and the vibrational motors (3) as well as the damping elements (5, 6) are assigned neither to the bicycle components of the vibrational ergometer nor to the term "frame superstructure" either.

This connection of the seat unit to the frame superstructure may be designed in a non-detachable manner or (for example for vertical adjustment) in a detachable manner, for example through a seat bolt.

According to a further embodiment of the present invention, the seat unit (20) is connected to a base plate (15) without any damping elements, while the vibrational unit is connected to said base plate by means of damping elements (5, 6).

Making use of simple and freely available means, this embodiment ensures that the transmission of vibrations from the vibrational unit to the seat unit (20) and/or the frame superstructure (17) is efficiently suppressed.

A further preferred embodiment relates to a version of the aforementioned vibrational ergometer with a frame superstructure (17), wherein said frame superstructure (17) is connected to the base plate (15) in a detachable manner.

This structural element allows to easily provide a manual crank ergometer and a bicycle ergometer in one and the same apparatus.

In this embodiment, the frame superstructure (17) can, for example, be detached from the front fork fixing means through commercial quick releases—the frame superstructure just needs to be swung away in order that the bicycle ergometer can be used as a hand crank ergometer. By swinging away the bicycle ergometer frame structure, a single apparatus allows separate training of muscular loops of the upper and lower extremities.

The modification of the seat unit (20) required to this end can be achieved easily through a holder for the detachable seat unit (20), said holder being arranged at the front fork fixing means. It is only necessary to "refit" the removable bicycle seat.

In addition, the bottom bracket/crank unit (1) can be fixed to a vertically adjustable support which is mounted to the plate vibrator (2).

This ensures individual or training-related adaptation to the trainee's anthropometric conditions.

In a further preferred embodiment, the vibrational motors (3) of the vibrational unit are frequency-controlled, whereby the vibration intensity can be varied and adjusted through a control (19), as desired or required.

In this manner, the intensity of the training or the therapy can be varied.

To vary the performance requirements for the user, the bottom bracket/crank unit (1) can, in particular, be connected to the braking unit (4) through a drive chain.

According to the embodiment described above, the braking unit (4) may be a manually adjustable braking resistor (4), in particular a braking resistor based on a magnet-inductive, an eddy or a friction brake.

In a further embodiment, the present invention relates to the application of the aforementioned vibrational ergometers as hand crank ergometers or as bicycle ergometers, in particular for therapy of rehabilitation and geriatric patients or competitive athletes, in order to increase the user's individual performance structure by selectively transmitting vibrations to the user's muscular loops.

In particular, such therapies comprise neuropathological symptoms, for example Parkinson's disease, ALS (amyotrophic lateral sclerosis), spinal paresis, spasticity, RLS (restless leg syndrome), multiple sclerosis, peripheral arteriovenous diseases, varicose veins, local ischemia, contractures, osteoporosis, postoperative rehabilitation, fall prevention, compensation of coordination deficits, arteriosclerosis prevention, and treatment of cardiovascular diseases.

The invention will be illustrated in more detail by means of the preferred exemplary embodiment described below without being restricted thereto.

Figure 1:
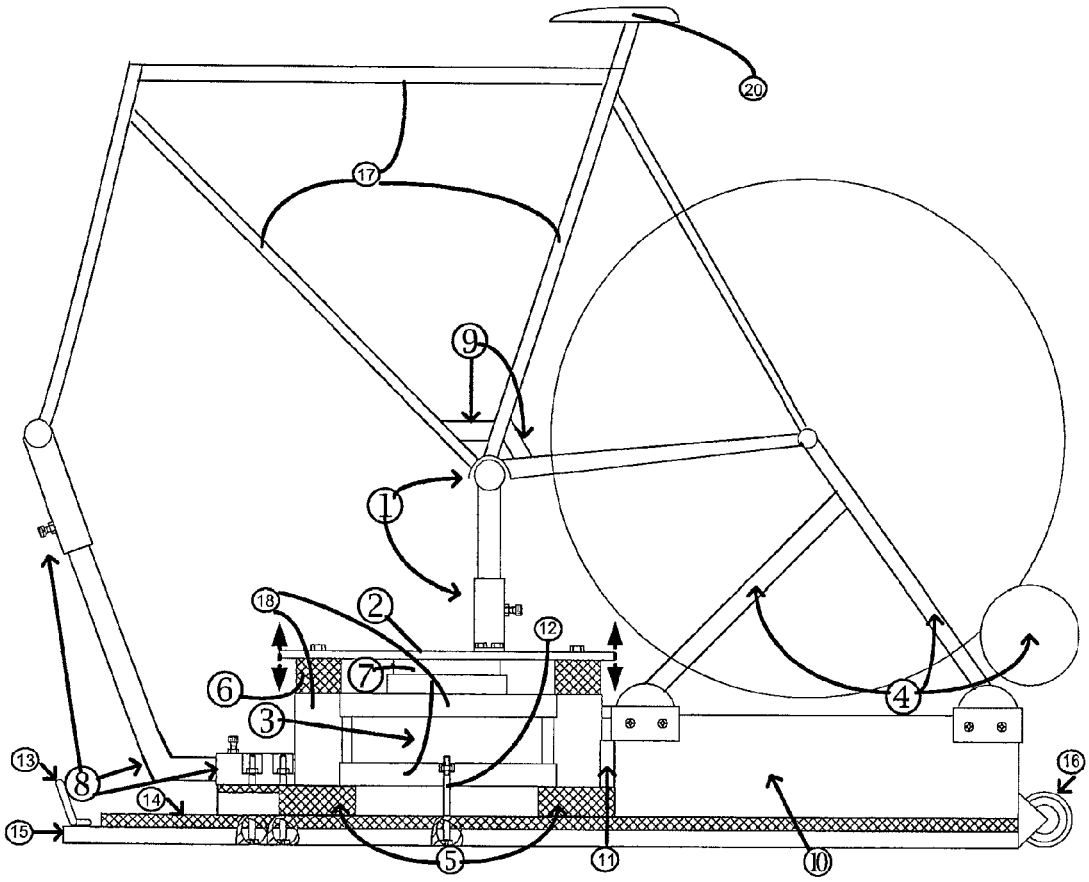
FIG. 1 is a lateral view of the apparatus according to the invention.

FIG. 1 shows the vibrational bicycle ergometer which comprises four structural regions: the vibrational stand 18 (materials used in the exemplary embodiment: aluminum, solid steel material and square profile tubes of stainless steel), the frame superstructure 17 (material used in the exemplary embodiment: chromium molybdenum steel alloy), the control pillar 19 (material used in the exemplary embodiment: aluminum/steel sheet), and a rear-wheel braking resistor 4 (material used in the exemplary embodiment: metal/plastic).

Towards the bottom, the vibrational stand 18 is provided with floor damping elements 5 which are intended to prevent or absorb the transmission of vibrations to the environment. In the exemplary embodiment, these floor damping elements 5 consist of foam disks or rubber-metal absorbers the number and/or hardness degree of which depends on the absorption desired and which are arranged between two circular metal-surface washers which are, together, mounted to the four solid-material corner pillars of the vibrational stand 18 through screwed fixing. For floor absorption, the entire apparatus is additionally placed on rubber mats 14 (natural rubber mats in the exemplary embodiment) which, in turn, are placed on a base plate 15 (material used in the exemplary embodiment: screen printing plate). The vibrational stand 18 is located to the base plate 15 by means of fixing means 12 (in the exemplary embodiment: six U-shaped loop holders each provided with two cup square neck bolts and self-locking nuts, with two of these U-shaped loop holders being arranged on each front/rear square tubes and one on each side square tube of the lower level). Towards the top, further absorption is achieved through rubber-metal absorbers 6 providing for a defined vibration of the mounted plate vibrator 2. Imbalance transmission is generated by vibrational motors 3 which are controlled from the control pillar 19.

To achieve this, a frequency converter with operator panel is used in the exemplary embodiment, with the design of said frequency converter being based on the operating parameters of the vibrational motors 3. A stiffening strip 7 (in the exemplary embodiment: aluminum alloy) extends on the bottom side of the plate vibrator 2 (in the exemplary embodiment: aluminum alloy), with the vibrational motors 3 being fixed to said stiffening strip 7. Separated from the front side of the frame of the vibrational stand and separately mounted to the base plate by means of two U-shaped loop holders and two cup square neck bolts each as fixing means, an attached connection piece is provided as fork fixing means 8, which serves as a length-adjustable holder of the obliquely attached and vertically adjustable guiding and holding equipment for the fork ends of the fork blade of the frame superstructure 17 (in the exemplary embodiment: square tube of stainless steel). This holding equipment is provided with a foam cushion between the attached connection piece and the square tube of the substructure supported on the base plate, this intended to absorb the transmission of vibrations to the handle bar of the frame superstructure (this effect can be intensified by installing a spring fork). A further vertically adjustable holder for the bottom bracket/crank unit 1 including pedals (in the exemplary embodiment: square tube of stainless steel) is mounted on the surface of the plate vibrator 2. This isolated drive unit vibrates freely below the frame superstructure 18. The frame superstructure 18 consists of a modified structural frame. The bottom bracket sleeve at the node of the saddle and down tubes and the chainstays is removed and replaced by a half shell with downward opening. The node is provided with frame stiffening elements 9 between the down and saddle tubes as well as between the chainstays and the saddle tube. On the one hand, the frame superstructure 18 is fixed to the fork ends of the fork blade and, on the other hand, to the rear-wheel suspension of the pressed screw union of the rear-wheel braking resistor 4. The frame superstructure 18 is provided with a saddle, a handle bar assembly, a speed-changing mechanism, a chain drive connection to the sprocket wheels of the bottom bracket/crank unit, a rear wheel with rear sprocket (graded gear changing options), a speed-changing mechanism, and a rear-wheel brake. In the exemplary embodiment, the mechanical resistor unit of the rear-wheel braking resistor 4 guides the rear wheel of the frame superstructure 18 on a cylindrical roll with a controllable magnet-inductive brake (a commercial roll called training roll). The braking resistor can be used to vary the user's performance requirements. To achieve this, a cable guide is supplied from the magnet-inductive brake to the handle bar, passing underneath the vibrational stand 18, said cable guide being connected to a lever unit at the handle bar. The resistance can also be generated by eddy brakes or friction mechanisms on moving gyrating masses replacing the rear wheel. The resistor unit is placed on a platform substructure 10 (in the exemplary embodiment: screen printing plate material) forming the base and holding equipment. Angular elements at the four corners of the platform substructure 10 locate the training roll and prevent displacements in position under load conditions. A stopper plate 11 arranged towards the vibrational stand 18 is attached to the front side of the platform substructure 10. This prevents the bottom bracket cave from striking against the half shell under full-load conditions when, due to the chain force and the horizontal flexibility of the two absorber levels, the plate vibrator 2 including bottom bracket sleeve is subject to displacements. In order to achieve an increased horizontal play between the bottom bracket sleeve and the half shell (which is then elliptical), the cutout of the node of the bottom bracket can be pulled out towards the chainstays in an asymmetrical manner.

Figure 2:
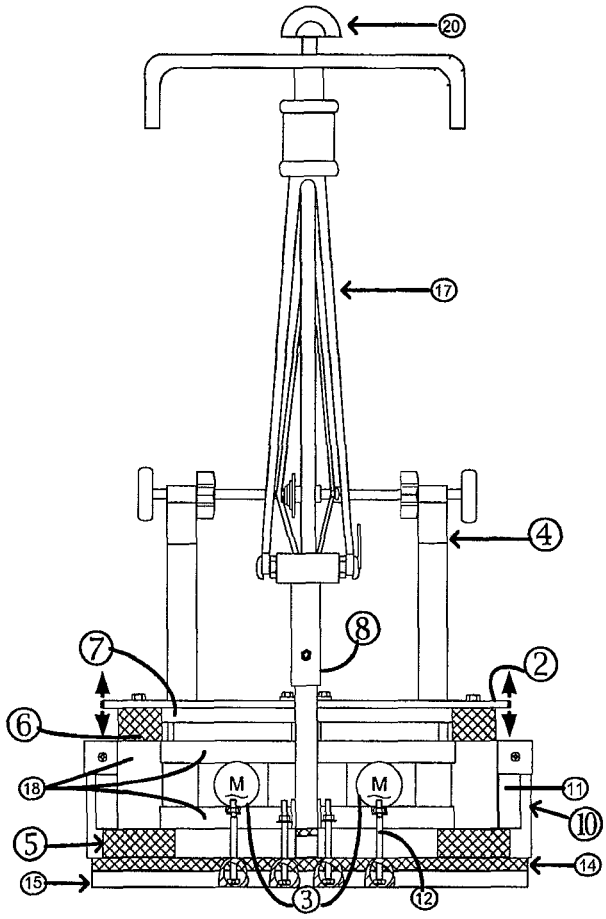
FIG. 2 is a front view of the apparatus.
Figure 3:
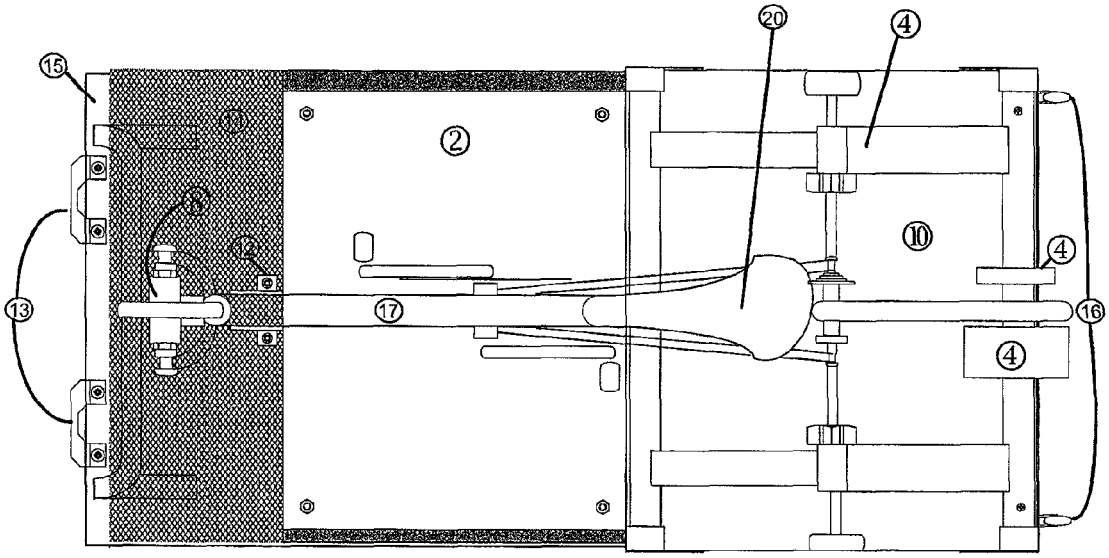
FIG. 3 is a top view of the apparatus.

FIGS. 2 and 3 are various perspective views illustrating the configuration of the aforementioned structural details in space. To facilitate transport of the mobile vibrational bicycle ergometer, transport grips 13 are mounted to the front side of the base plate 15 while transport rolls 16 are mounted to the rear side of the construction. The plate vibrator 2, the vibrational stand 18 including vibrational motors 3, and the damping elements 5 and 8 represent the complete vibrational unit. On the one hand, the bottom bracket/crank unit 1 is connected to said vibrational unit and, on the other hand, it is mechanically decoupled from the frame superstructure 17 with regard to transmission of vibrations.

Figure 4:
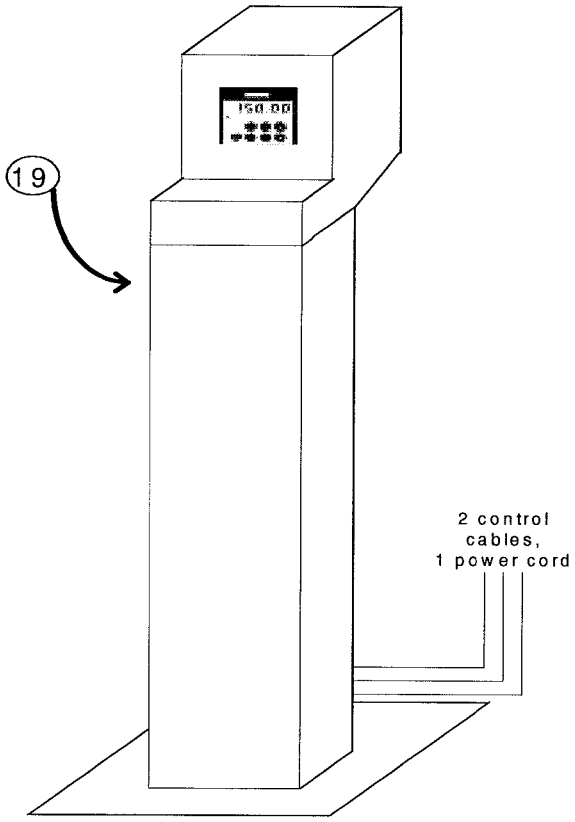
FIG. 4 is a perspective view of the control pillar pertaining to the apparatus.

FIG. 4 shows the control pillar 19 which, on the one hand, serves as a cable guide for the supply line between the vibrational motors 3 and the electronic control assemblies and, on the other hand, as a holder for the control unit. The latter is formed by a frequency converter which generates the speed regulation of the vibrational motors 3 and the resulting vibration frequency of the plate vibrator 2. The display of the control unit shows the vibration and motor speed parameters while manual regulation is achieved through a keypad.

Various materials can be used for the components of the vibrational bicycle ergometer, provided the properties of such materials do not limit the functionality. To save weight, the metal/wood components can be made of carbon fiber or GFK materials. Foam mats underneath the base plate are provided as a support for the entire structure, preventing floor unevenness towards the smooth bottom side and stopping the transmission of resonances to the environment.

Pictures 1, 2, 3*a*, 3*b*, 4, 5, and 6 reflect a vibrational bicycle ergometer according to the invention.

| List of reference numbers | |
|---|---|
| 1 | Bottom bracket/crank unit |
| 2 | Plate vibrator |
| 3 | Vibrational motor |
| 4 | Rear-wheel braking resistor |
| 5 | Floor damping element |
| 6 | Rubber metal absorber |
| 7 | Stiffening strip |
| 8 | Fork fixing means |
| 9 | Frame stiffening element |
| 10 | Platform substructure |
| 11 | Stopper plate |
| 12 | Fixing means |
| 13 | Transport grips |
| 14 | Rubber mats |
| 15 | Base plate |
| 16 | Transport rolls |
| 17 | Frame superstructure |
| 18 | Vibrational stand |
| 19 | Control pillar |
| 20 | Seat unit |

The invention claimed is:

1. An apparatus for training a trainee by causing vibration communicated to first extremities of said trainee to be less than vibration communicated to second extremities of said trainee, said apparatus comprising a vibrational ergometer, said vibrational ergometer including a saddle upon which said trainee is to be seated, a vibrator plate, a vibrational motor coupled to said vibrator plate, wherein said vibrational motor is frequency-controlled, whereby vibration intensity can be varied and adjusted by means of frequency control, a bottom bracket/crank unit connected to said vibrator plate, said bottom bracket/crank unit being vibrationally isolated from said saddle, and a braking unit connected to said bottom bracket/crank unit.

2. The apparatus of claim 1, wherein said bottom bracket/crank unit is vibrationally isolated to an extent such that less than 5% of energy generated at said vibrator plate reaches a head of said trainee.

3. The apparatus of claim 1, wherein said bottom bracket/crank unit is vibrationally isolated to an extent such that less than 50% of energy generated at said vibrator plate reaches knees of said trainee.

4. The apparatus of claim 1, wherein said bottom bracket/crank unit is vibrationally isolated to an extent such that less than 5% of energy generated at said vibrator plate reaches a head of said trainee and less than 50% of energy generated at said vibrator plate reaches knees of said trainee.

5. The apparatus of claim 1, wherein said bottom bracket/crank unit is vibrationally isolated to an extent such that less than 5% of energy generated at said vibrator plate reaches a head of said trainee, less than 50% of energy generated at said vibrator plate reaches knees of said trainee, and at least 80% of energy generated at said plate reaches ankles of said trainee.

6. The apparatus of claim 1, wherein said bottom bracket/crank unit is vibrationally isolated to an extent such that at least 80% of energy generated by said vibrator plate reaches ankles of said trainee and less than 5% of said energy reaches a head of said trainee.

7. The apparatus of claim 1, further comprising a vibrational stand disposed under said vibrator plate.

8. The apparatus of claim 1, wherein said braking unit comprises a rear-wheel braking resistor.

9. The apparatus of claim 1, wherein said vibrational motor and said vibrator plate are contained in a vibration unit, and wherein said bottom bracket/crank unit is mounted to said vibrational unit as a separate assembly.

10. The apparatus of claim 1, further comprising a frame superstructure connected to said saddle, said frame superstructure being vibrationally isolated from said vibrator plate.

11. The apparatus of claim 1, further comprising a base plate connected by damping elements to a vibrational unit that includes said vibrator plate and said motor and connected to said saddle without damping elements.

12. The apparatus of claim 11, further comprising a frame superstructure connected to said saddle said frame superstructure being detachable from said base plate.

13. The apparatus of claim 1, further comprising a vertically adjustable support attached to said vibrator plate, said bottom bracket/crank unit being mounted to said vertically adjustable support.

14. The apparatus of claim 1, further comprising a drive chain for connecting said braking unit to said bottom bracket/crank unit in order to vary performance requirements for said trainee.

15. The apparatus of claim 1, wherein said braking unit comprises a manually adjustable braking resistor.

16. The apparatus of claim 1, wherein said braking unit comprises a magneto-inductive brake.

17. The apparatus of claim 1, wherein said braking unit comprises an eddy brake.

18. The apparatus of claim 1, wherein said braking unit comprises a friction brake.

19. The apparatus of claim 1, wherein said saddle is disposed such that said first extremities of said trainee are disposed below said second extremities of said trainee.

20. The apparatus of claim 1, wherein said bottom bracket/crank unit is disposed between said vibrator plate and said saddle.

21. The apparatus of claim 1, wherein said vibrational ergometer comprises a hand crank ergometer.

22. The apparatus of claim 1, wherein said vibrational ergometer comprises a bicycle ergometer.

* * * * *